United States Patent [19]

Moriya et al.

[11] Patent Number: 4,986,179

[45] Date of Patent: Jan. 22, 1991

[54] PRINT HEAD FOR DOT MATRIX PRINTERS

[75] Inventors: Takashi Moriya; Masahiko Ueda; Toshihiro Endo, all of Tokyo, Japan

[73] Assignee: Citizen Watch Co., Ltd., Tokyo, Japan

[21] Appl. No.: 383,413

[22] Filed: Jul. 20, 1989

[30] Foreign Application Priority Data

Jul. 25, 1988 [JP] Japan ..... 63-185879

[51] Int. Cl.[5] ..... B41J 2/22; B41J 9/38

[52] U.S. Cl. ..... 101/93.04; 101/93.05; 400/124

[58] Field of Search ..... 101/93.04, 93.05, 93.29; 400/124

[56] References Cited

U.S. PATENT DOCUMENTS

| | | | |
|---|---|---|---|
| 3,386,378 | 6/1968 | Bradbury et al. | 101/93.04 |
| 3,513,773 | 5/1970 | Ponzano | 101/93.04 |
| 4,462,705 | 7/1984 | Hayashi et al. | 101/93.04 |
| 4,572,681 | 2/1986 | Miyazawa et al. | 400/124 |
| 4,634,301 | 1/1987 | Sakaida et al. | 400/124 |
| 4,704,041 | 11/1987 | Hayashi et al. | 101/93.05 |
| 4,832,515 | 5/1989 | Kawakami | 400/124 |

FOREIGN PATENT DOCUMENTS

| | | |
|---|---|---|
| 0022340 | 1/1981 | European Pat. Off. . |
| 1041323 | 9/1966 | United Kingdom . |
| 1432508 | 5/1974 | United Kingdom . |
| 2142582 | 1/1985 | United Kingdom . |

*Primary Examiner*—David A. Wiecking
*Assistant Examiner*—C. A. Bennett
*Attorney, Agent, or Firm*—Koda and Androlia

[57] ABSTRACT

A stylus actuator unit for dot matrix line printers in which each electromagnetic actuator drives each stylus.

An armature is rockably supported by the electromagnetic actuator while fixing a stylus for printing to one end thereof and having at the other end thereof a plunger to be attracted by the electromagnetic actuator. At an intermediate between the stylus fixing end and the plunger fixing end of armature is provided an armature support member composed of a torison leaf spring which is supported by a yoke base mounted on the electromagnetic actuator.

The torsion leaf spring has a configuration of the letter E and both side portions are fixed to the yoke base and the central portion supports the armature. When the electromagnetic actuator attracts the plunger, the armature on the side of the stylus is driven in the opposite direction to the direction of attraction, thereby enabling the stylus to impact to the paper placed over the outer periphery of the platen.

6 Claims, 5 Drawing Sheets

PRINT HEAD FOR DOT MATRIX PRINTERS

BACKGROUND OF THE INVENTION

1. Field of the Invention

The present invention relates to a print head for dot matrix printers and, more particularly, to a print head for dot matrix printers for impacting a printing stylus held by an armature toward the paper placed over the outer periphery of a platen by the swift movement of the armature energized and driven and electromagnet.

2. Description of the Prior Art

Dot matrix printers for forming letters and symbols such as numerals on recording paper by the dot matrix are well known. Since the shapes of all kinds of letters and symbols are synthesized as desired, dot matrix printers have recently been used in various fields as printers of information processing apparatus. Such a dot matrix printer has a plurality of styli, and printing operation is carried out by the impact operation of the end portions of the styli. The impact operation of the stylus is carried out by attracting or releasing an armature fixed at one end of the stylus at a predetermined timing by an electromagnet. As the structure of the styli and the driving portions of the armatures of such a print head are conventionally known the type of the system in which the impact operation is carried out by attracting the armature such as those disclosed in Japanese Patent Laid-Open Nos. 64459/1986 and 33463/1988, and U.S. Pat. No. 4,230,038, and the type of the system in which the impact operation is carried out by releasing the armature such as those disclosed in Japanese Utility Model Laid-Open Nos. 147/1985 and 3039/1985, and U.S. Pat. Nos. 4,634,301 and 4,652,158.

FIGS. 5(A) and 5(B) are a plan view and a side elevational view, respectively, of the stylus and the driving portion of the armature of the prior-art print head of the type of the system in which the impact operation is carried out by releasing the armature.

At one end of an armature 10, a stylus 12 is fixed. The other end of the armature is fixed to a print head holder 14 by a rod-like torsion spring 16. The torsion spring 16 is biased with a torsional force so that the armature 10 is driven to the impact operation when the armature 10 is released from the attraction of the electromagnet. The print head holder 14 is secured to the armature 10 by locating the end portion of the armature 10 between the branched portions 14*a*, 14*b* at the end of the print head holder 14 on the side of the armature 10, and piercing the branched portions 14*a*, 14*b* and the end portion of the armature 10 with the rod-like torsion spring 16.

The printing operation of the stylus 12 of such a dot matrix printer is carried out by releasing the armature 10 from the energizing means so as to drive the stylus 12 in the direction of impact. The impact operation of the armature 10 is performed with the rod-like torsion spring 16 as the fulcrum, and the driving force is produced by the spring return force of the torsion spring 16 which is provided in advance with torsion by the attraction of the electromagnet.

However, in the apparatus disclosed in Japanese Patent Laid-Open No. 64459/1986 having a system in which the impact operation is carried out by attraction of the armature, since the electromagnet on the armature is situated on the side of the stylus (on the impact operation side), the length of the stylus 12 inevitably becomes long because it is necessary for the stylus 12 to cross the electromagnet to reach the recording paper.

In the apparatus disclosed in U.S. Pat. No. 4,230,038, although the electromagnet is situated on the opposite side of the armature relative to the stylus, a long wire is also used because it is necessary to bundle a plurality of styli at the center.

In the case of using such a long stylus, since the mass of the stylus is large, the printing speed is lowered and a stylus guide is required. The provision of a stylus guide involves a danger of deteriorating the printing performance due to the wear of the stylus guide.

According to the structure of the stylus and the driving portion of the armature shown in FIGS. 5(A) and 5(B) and used in the apparatus disclosed in Japanese Utility Model Laid-Open No. 147/1985 and U.S. Pat. No. 4,634,301, since the rod-like torsion spring 16 supporting the armature 10 at the end thereof is provided with a torsional force which warps the torsion spring 16 toward the direction of impact of the armature 10, it is necessary for securing the accurate impact operation to effectively prevent the bending caused by the torsion, namely, the warping of the torsion spring 16 in a direction deviated from the axial direction. Therefore, the rod-like torsion spring 16 is required both to secure sufficient rigidity for preventing bending and to secure the torsional spring property. Due to these contradictory requirements, the material and the configuration of the torsion spring are restricted.

In order to provide a torsional force for the torsion spring 16, it is necessary to firmly secure the torsion spring 16 to the branched portions 14*a*, 14*b* of the print head holder 14 and the armature 10 so as to prevent the positional deviation in the direction of rotation with respect to the armature 10. In this case, since it is necessary that the rod-like torsion spring 16 is narrow to a certain extent in order to secure the torsion force, if the torsion spring 16 is fixed by brazing, the brazing operation becomes complicated, resulting in the rise in cost. If the torsion spring 16 is fixed by screwing or press fitting, there is a fear of insufficient fixture. If the fixture of the torsion spring 16 is insufficient, the positional deviation in the rod-like torsion spring 16 is produced during printing, which disadvantageously results in the shortage of starting force of the armature, thereby making the impact operation impossible.

In this way, highly accurate and difficult operation is required for securing the rod-like torsion spring 16 to the armature 10, thereby inconveniently raising the cost.

Furthermore, since the fulcrum for driving the armature 10 (the position of the rod-like torsion spring 16) is located at the end of the armature 10, it is necessary to dispose the electromagnet between the end portion of the armature 10 and the stylus 12, so that if the energizing means serving as the means for driving the armature 10 is disposed on the opposite side of the armature 10 relative to the direction of impact (lower side in FIG. 5(B)), it is impossible to utilize the attraction of the energizing means for the impact operation of the armature 10 as it is.

It is therefore necessary to release the attraction of the energizing means for effecting the impact operation, and for this purpose, members such as a permanent magnet and a spring as well as the energizing means are required, thereby complicating the structure.

SUMMARY OF THE INVENTION

Accordingly, it is an object of the present invention to eliminate the above-described problems in the prior art and to provide a print head for dot matrix line printers which is capable of shortening the length of the stylus in spite of the armature attraction type print head, obviating the provision of a permanent magnet and a stylus guide, enhancing the printing reliability and providing an armature mounting portion having a simple structure with desired rigidity.

To achieve this aim, the present invention provides a print head for dot matrix printers having a plurality of stylus actuator units mounted on a head frame. Each of the unit having an electromagnetic actuator fixed to a head frame and energized by an impact driving current, and an armature rockably supported to a yoke base by the torsion leaf spring while fixing a stylus for printing to one end thereof and having at the other end thereof a plunger attracted by the electromagnetic actuator, whereby the printing stylus is impacted to recording paper by attracting the plunger when the impact driving current is supplied to the electromagnetic actuator, characterized in that a support member provided at an intermediate position between the stylus fixing end and the plunger fixing end for rockably supporting the armature on the yoke base so as to reverse the direction in which the stylus is impacted to the direction in which the plunger is attracted, the support member being composed of a torsion leaf spring with both side portions being coplanarly fixed to the yoke base and the central portion supporting the armature fixed thereto, the central portion having a torsion property in the direction in which the stylus is impacted with respect to the stationary side portions; the torsion spring having a bent portion at at least one part thereof produced by bending the torsion spring in the direction substantially orthogonal to the plane in which the side portions are fixed to the yoke base so as to enhance the rigidity and prevent the torsion spring from warping.

In the print head for dot matrix printers having the above-described structure, the armature support member is provided at the intermediate position between the stylus fixing end and the plunger fixing end on the armature so as to reverse the direction in which the stylus is impacted to the direction in which the plunger is attracted, whereby it is possible to dispose members such as an electromagnet for attracting the armature on the rear side of the armature (opposite side of the armature relative to the stylus). It is therefore unnecessary to provide a space for disposing members such as an electromagnet between the plunger and the recording paper to which the stylus is impacted, thereby enabling a short stylus structure. In this way, the buckling or the like of the stylus is effectively prevented, the impacting efficiency is enhanced and the impacting speed is enhanced due to the reduction of the mass of the stylus. In addition, since a stylus guide is dispensed with, there is no wear of the stylus guide and the stylus, thereby preventing a defect in operation.

The armature support member is composed of a torsion leaf spring made of a thin metal sheet. Both sides of the torsion leaf spring are fixed to the yoke base at two points, and to the central portion thereof, which is a free end, the armature is fixed. The mass of the armature is therefore well-balanced with the fulcrum as the center, thereby making the armature difficult to move by external impact force. Since the armature is supported in the state of being free from friction, the durability thereof is enhanced in comparison with an armature supported by a shaft, a bearing and the like. In addition, the bent portion for preventing warping is provided at the torsion leaf spring, which effectively prevents the torsion spring from being pulled and warped in the direction in which the armature is attracted when the plunger attached to the armature is attracted to the side of the electromagnetic actuator.

It is possible to adjust the torsional rigidity and the rigidity in the direction of warping in the planning stage by appropriately setting the upright length of the bent portion and the configuration and the thickness of the thin sheet of the torsion leaf spring.

By adopting the torsion leaf spring, the difficult fixing operation which is required for attaching a conventional rod-like torsion spring is obviated. It is easy to attach the torsion leaf spring to the stylus actuator unit by securing the torsion leaf spring to a flat sheet member by bolts or the like, thereby diminishing the possibility of a defect in operation due to insufficient tightening which may be caused in the case of screwing the rod-like spring.

The above and other objects, features and advantages of the present invention will become clear from the following description of the preferred embodiment thereof, taken in conjunction with the accompanying drawings.

BRIEF DESCRIPTION OF THE DRAWINGS

FIGS. 3(A) to 3(C) are explanatory views of a torsion leaf spring, which is a component characteristic of the present invention, wherein FIG. 3(A) is a plan view;

FIG. 3(B) is an elevational view; and

FIG. 3(C) is a side elevational view thereof;

FIGS. 4(A) and 4(B) are explanatory views of a torsion leaf spring with an armature attached thereto, wherein FIG. 4(A) is a plan view; and FIG. 4(B) is a side elevational view thereof; and FIGS. 5(A) and 5(B) show the driving portion of the armature of a conventional print head, wherein FIG. 5(A) is a plan view; and FIG. 5(B) is a side elevational view thereof.

DESCRIPTION OF THE PREFERRED EMBODIMENT

A preferred embodiment of a print head for dot matrix line printers according to the present invention will be explained with reference to the accompanying drawings.

Figure 1:
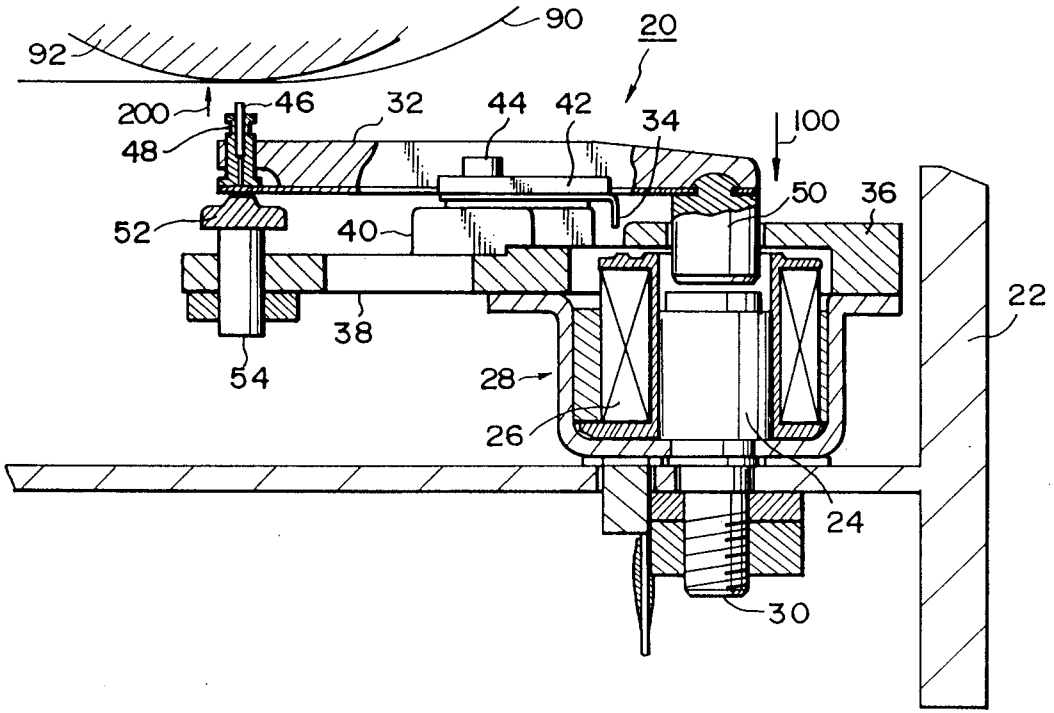
FIG. 1 is a schematic sectional view of the entire structure of an embodiment of a print head according to the present invention.

FIG. 1 is a schematic view of the entire structure of an embodiment of a print head according to the present invention. A plurality of completed stylus actuator units 20 are arranged in parallel to each other and secured to a head frame 22 at predetermined positions which enable the respective stylus actuator units to impact to the recording paper 90 placed over the outer periphery of a platen 92. The completed stylus actuator units 20 are secured to the head frame 22 by fixing screws 30 provided on electromagnetic actuators 28 each of which is formed by winding a coil 26 around a core 24.

A single stylus actuator unit 20 will be explained hereinunder.

The feature of the present invention lies in the structure of the support member for an armature 32 driven by the electromagnetic actuator 28. The armature 32 is secured to the central portion of a torsion leaf spring 34 which has a torsion property, and the torsion leaf spring 34 is attached to the stylus actuator unit 20, thereby supporting the armature 32.

In this embodiment, a torsion leaf spring rest 40 is mounted on a support rack portion 38 which is elongated from a yoke base 36 along the longitudinal axis thereof. The torsion leaf spring 34 is placed on the torsion leaf spring rest 40 at an appropriate position, and fixed thereon by fixing bolts 44 through spring pressers 42. In this way, the support member of the torsion leaf spring 34 is fixed to the torsion leaf spring rest 40.

Figure 2:
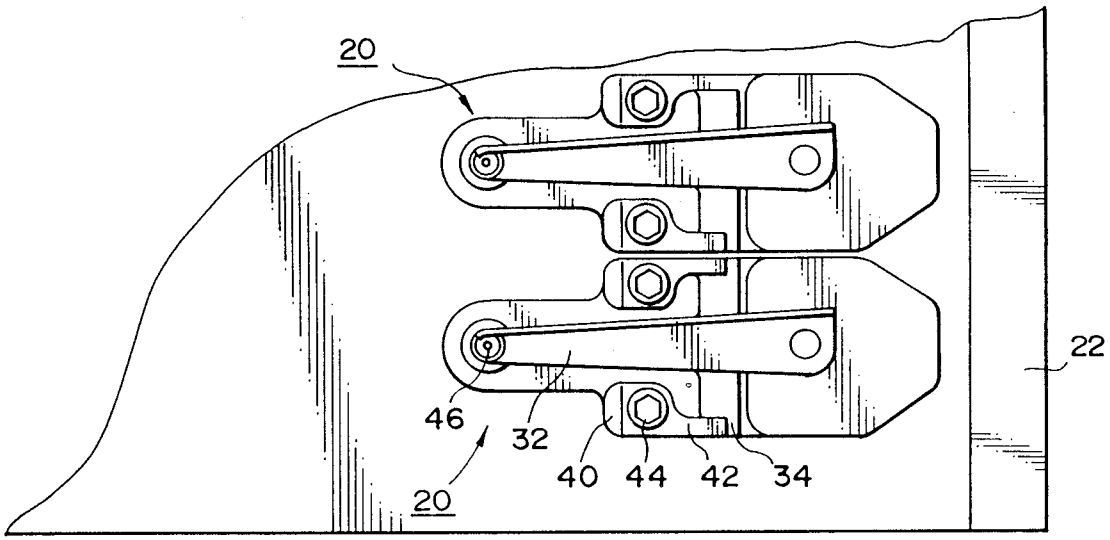
FIG. 2 shows the embodiment shown in FIG. 1, in the state of being attached to the head frame.

FIG. 2 shows the embodiment shown in FIG. 1, as seen from the direction indicated by the arrow 100. Although two completed stylus actuator units 20 are shown in FIG. 2, actually, a multiplicity of stylus actuator units 20 are arranged for printing one line with dot matrixes at a high speed, as described above.

The armature 32 is attached to the torsion leaf spring 34 by brazing or spot welding.

A stylus 46 is attached to one end of the armature 32 through a stylus holder 48. At the other end of the armature 32, a plunger 50 attracted by the coil of the electromagnetic actuator 28 is fixed. The plunger 50 is attached to the side of the electromagnetic actuator 28 (the lower side in FIG. 1) on the armature 32. On the other hand, the stylus 46 is attached to the recording paper side (the upper side in FIG. 1) of the armature 32. Accordingly, when the plunger 50 is attracted against the torsional force of the torsion leaf spring 34, the stylus 46 moves with the torsion leaf spring 34 as a fulcrum in the direction opposite to the direction in which the plunger 50 is attracted (the direction indicated by the arrow 200), thereby effecting the impact operation.

A damper 52 is attached to a portion below the stylus holder 48 in the vicinity thereof in order to absorb the shock produced when the attraction of the plunger 50 by the electromagnetic actuator 28 is stopped and the stylus 46 is restored to the original position by the torsional force of the torsion leaf spring 34. The damper 52 is secured to the support rack portion 38 by a screw 54.

FIGS. 3(A), 3(B), 3(C), 4(A) and 4(B) respectively show the torsion leaf spring 34 and the armature 32 attached to the torsion leaf spring 34.

Figure 3A:
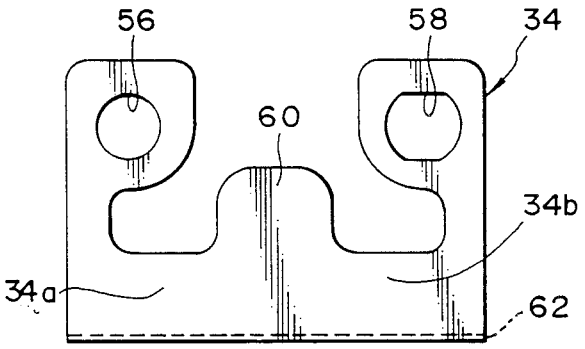
Figure 3C:
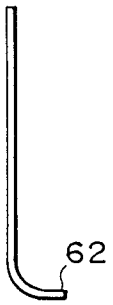
Figure 3B:
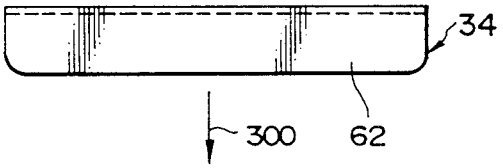

FIG. 3(A) is a plan view of the torsion leaf spring 34, FIG. 3(B) an elevational view and FIG. 3(C) a side elevational view thereof. At both side portions of an E-shaped torsion leaf spring 38 are provided holes 56 and 58 for receiving bolts for fixing the torsion leaf spring 34 on the torsion leaf spring rest 40 of the stylus actuator unit 20. An armature mounting portion 60 for attaching the armature to the torsion leaf spring 38 is formed at the central portion of the torsion leaf spring 38. As is clear from FIG. 3(A), bridge portions 34*a* and 34*b* are provided between the respective holes 56, 58 for fixing the side portions and the armature mounting portion 60. The warping of the bridge portions 34*a*, 34*b* provides the armature 32 with a desired torsional force as a force for restoring the stylus 46 to the original portion after the impact operation. The present invention is further characterized in that a bent portion 62 is formed at the end portion of the torsion leaf spring 34 facing the plunger 50 in the state in which the armature 32 is attached to the torsion leaf spring 34. The bent portion 62 is provided for effectively preventing the torsion leaf spring 34 from warping in the direction indicated by the arrow 300 in FIG. 3(B), as will be described later.

Figure 4A:
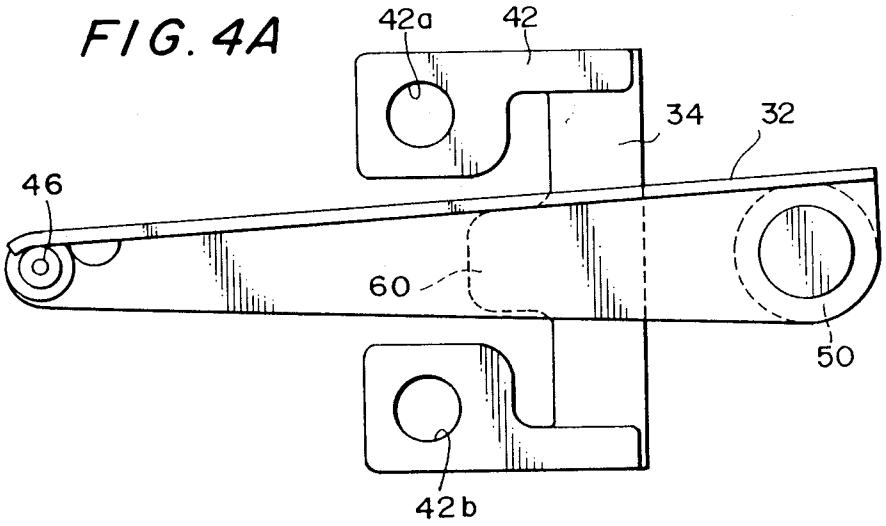
Figure 4B:
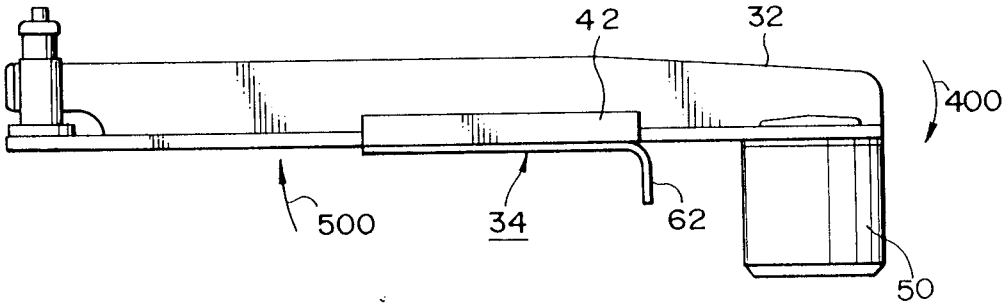
Figure 5B:
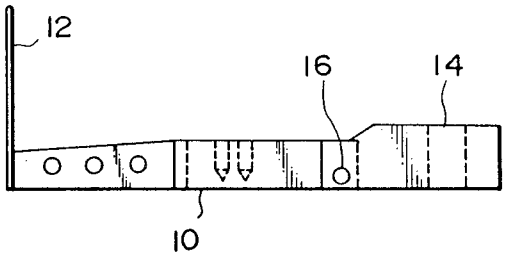
FIG. 5B PRIOR ART
Figure 5A:
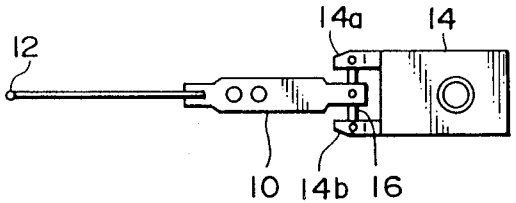
FIG. 5A PRIOR ART

FIG. 4(A) is a plan view of the torsion leaf spring 34 with the armature 32 fixed thereto by brazing or welding, and FIG. 4(B) is a side elevational view thereof. The bottom portion of the armature 32 is fixed to the armature mounting portion 60 of the torsion leaf spring 34 by brazing or welding with the plunger 50 being situated on the side of the bent portion 62 of the torsion leaf spring 34.

To the upper surface of the torsion leaf spring 34, the spring pressers 42 are secured by welding or adhesion. The spring pressers 42 are provided with openings 42*a* and 42*b* for receiving the fixing bolts 44. When the torsion leaf spring 34 is fixed by the fixing bolts 44 and the spring pressers 42, the portions (stationary surfaces) at which the torsion leaf spring 34 is fixed by the spring pressers 42 are maintained on the support rack portion 38 in a constantly non-deformed state. On the other hand, the bridge portions 34*a* and 34*b* between the respective stationary portions and the armature mounting portion 60 to which the armature 32 is secured have a torsional property and are biased in the directions indicated by the arrows 400 and 500, respectively, thereby enabling the impact operation of the stylus 46.

The operation of this embodiment will now be explained.

For starting the printing operation on recording paper, a predetermined impact driving current is first supplied to the electromagnetic actuator 28, thereby energizing the core 24 for attracting the plunger 50 of the armature 32. At this time, the stylus 46 attached to the other end of the armature 32 is driven in the direction of impact which is opposite to the direction in which the plunger 50 is attracted. This operation is carried out by the torsional operation of the armature mounting portion 60. Thus, dot printing is performed by the end portion of the stylus 46.

Since the armature 32 with the stylus 46 attached thereto is fixed at the central portion of the torsion leaf spring 34 which has a torsion property, it is supported in the state of being free from friction, so that the durability thereof is enhanced in comparison with an armature supported by a shaft and a bearing, and high-accuracy impact operation is enabled.

In this embodiment, the direction in which the plunger 50 is attracted is reversed to the direction in which the stylus 40 impacts, thereby enabling a wire for performing dot impact to adopt a short stylus structure.

That is, since it is unnecessary to provide an electromagnet for attracting the stylus 46 on the impact operation side of the stylus 46, it is possible to dispose the armature 32 at a position closer to recording paper.

Due to the short stylus structure, a stylus guide for introducing the stylus is dispensed with, thereby simplifying the structure and reducing the cost. Since the bending stress applied to the stylus 46 is reduced, there is no need to consider the fatigue limit with respect to the bending stress, thereby relaxing the limitation in the materials used. For example, it is possible to use cheap material having good wear resistance and such as a hard metal.

Even if a high impact force is required, since the stylus is short, there is no fear of reduction in the impact force due to buckling.

The operation of the bent portion 62 of the torsion leaf spring 34 which is a component characteristic of the present invention will here be explained. The bent portion 62 effectively prevents the torsion leaf spring 34 from warping when the plunger 50 is attracted for printing operation.

More specifically, by forming the bent portion 62 the rigidity of the torsion leaf spring 34 is increased so much as to prevent the armature mounting portion 60 of the torsion leaf spring 34 from warping toward the core 24 when the plunger 50 is attracted toward the core 24.

According to the torsion leaf spring 34 of this embodiment, it is possible to set the rigidity in the direction of warping of the torsion leaf spring 34 by setting the length of the upright portion of the bent portion 62, and it is also possible to set the torsional rigidity of the torsion leaf spring 34 in the direction of impact of the stylus 46 by setting the plane configuration of the torsion leaf spring 34 except the bent portion 62.

As described above, according to this embodiment, it is possible to support the armature 32 with the stylus 46 attached thereto in the state of being free from friction by the torsion leaf spring 34 of a simple structure produced by bending a flat sheet into an L shape.

As explained above, according to a print head for dot matrix printers of the present invention, by reversing the direction in which the armature is attracted to the direction in which the stylus impacts, a short stylus structure is realized, thereby enhancing the printing performance and obviating the need for a stylus guide.

The armature supporting portion through which the armature is supported by the print head unit is composed of a thin sheet having an L-shaped section. Thus, it is possible to produce a cheap armature supporting portion having a simple structure and capable of supporting the armature in the state of being free from friction, thereby enhancing the durability of the armature supporting portion and enabling accurate impact driving.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. In a print head for dot matrix printers comprising:

a head frame and a plurality of stylus actuator units being arranged in parallel to each other and secured to said head frame;

each of said stylus actuator unit having;

an electromagnetic actuator fixed to said head frame and energized by an impact driving current, a yoke base fixed to said stylus actuator unit, an armature rockably supported to said yoke base while fixing a stylus for printing to one end thereof and having at the other end thereof a plunger attracted by said electromagnetic actuator, whereby said stylus is impacted to recording paper by attracting said plunger when said impact driving current is supplied to said electromagnetic actuator:

the improvement comprising:

a support member supporting said armature at an intermediate position between the stylus fixing end and the plunger fixing end on said yoke base such that the direction in which said stylus is impacted is reversed to the direction in which said plunger is attracted;

said support member being composed of a torsion leaf spring having two side portions, a central portion, and an end portion with both side portions being coplanarly fixed to said yoke base and the central portion supporting said armature fixed thereto, said central portion having a torsion property in the direction of impact of said stylus with respect to the stationary side portions;

said torsion spring being provided at at least one part thereof with a bent portion which is bent in the direction substantially orthogonal to the plane in which said side portions are fixed so as to enhance the rigidity of said torsion spring and prevent said torsion spring from warping.

2. A print head for dot matrix printers according to claim 1, further comprising:

a support rack portion elongated from said yoke base along the longitudinal axis thereof for supporting said armature; and a torsion leaf spring rest secured to said support rack portion so as to fix said stationary side portions of said torsion leaf spring.

3. A print head for dot matrix printers according to claim 2, wherein said support rack portion carries a damper disposed in the vicinity of the stylus fixing end of said armature so as to absorb the shock produced when said armature is bouncing against the original position thereof.

4. A print head for dot matrix printers according to claim 2, wherein said torsion leaf spring has a configuration of the letter capital E and is provided at both side portions with a fixing portion for fixing said torsion leaf spring on said yoke base and at the central portion with a fixing portion for fixing said armature.

5. A print head for dot matrix printers according to claim 4, wherein said torsion leaf spring is provided with bridge portions between said fixing portion for fixing said torsion leaf spring on said yoke base and said fixing portion for fixing said armature so as to mainly provide with said torsion leaf spring with a desired warping.

6. A print head for dot matrix printers according to claim 1, wherein said bent portion is on the end portion of said torsion leaf spring and is bent in the direction of the plunger.

* * * * *